US006055974A

United States Patent [19]

Dieziger

[11] Patent Number: 6,055,974

[45] Date of Patent: May 2, 2000

[54] COMPOUND BOW WITH FACILITATED DRAW

[76] Inventor: David Dieziger, 9755 Horseback Ridge Rd., Missoula, Mont. 59804

[21] Appl. No.: 09/321,169

[22] Filed: May 27, 1999

[51] Int. Cl.[7] ..... F41B 5/00; F41B 5/10

[52] U.S. Cl. ..... 124/23.1; 124/25.6

[58] Field of Search ..... 124/23.1, 25.6, 124/86

[56] References Cited

U.S. PATENT DOCUMENTS

| | | | |
|---|---|---|---|
| 4,471,747 | 9/1984 | Nishioka | 124/23.1 |
| 4,530,342 | 7/1985 | Simo | 124/25.6 X |
| 4,757,799 | 7/1988 | Bozek | 124/25.6 |
| 4,858,588 | 8/1989 | Bozek | 124/25.6 X |
| 5,146,908 | 9/1992 | Larson | 124/25.6 X |
| 5,445,139 | 8/1995 | Bybee | 124/23.1 |

*Primary Examiner*—John A. Ricci

[57] ABSTRACT

A draw facilitating bow assembly for use with a compound bow is provided including a set member coupled to a handle portion of the bow and extending rearwardly therefrom. Also included is a pair of tension assemblies mounted on ends of the bow. Next provided is a cable wrapped about the tension assemblies for being removably positioned on the set member for allowing the bow to be more easily drawn.

4 Claims, 7 Drawing Sheets

COMPOUND BOW WITH FACILITATED DRAW

BACKGROUND OF THE INVENTION

1. Field of the Invention

The present invention relates to compound bows and more particularly pertains to a new compound bow with facilitated draw for allowing a bow string to be more easily drawn after which a strength of the bow may be restored prior to release.

2. Description of the Prior Art

The use of compound bows is known in the prior art. More specifically, compound bows heretofore devised and utilized are known to consist basically of familiar, expected and obvious structural configurations, notwithstanding the myriad of designs encompassed by the crowded prior art which have been developed for the fulfillment of countless objectives and requirements.

Known prior art compound bows include U.S. Pat. No. 5,054,463; U.S. Pat. No. 4,739,744; U.S. Pat. No. 3,851,638; U.S. Pat. No. 4,478,202; U.S. Patent Des. 282,481; and U.S. Pat. No. 3,486,495 which are each incorporated herein by reference.

In these respects, the compound bow with facilitated draw according to the present invention substantially departs from the conventional concepts and designs of the prior art, and in so doing provides an apparatus primarily developed for the purpose of allowing a bow string to be more easily drawn after which a strength of the bow may be restored prior to release.

SUMMARY OF THE INVENTION

In view of the foregoing disadvantages inherent in the known types of compound bows now present in the prior art, the present invention provides a new compound bow with facilitated draw construction wherein the same can be utilized for allowing a bow string to be more easily drawn after which a strength of the bow may be restored prior to release.

The general purpose of the present invention, which will be described subsequently in greater detail, is to provide a new compound bow with facilitated draw apparatus and method which has many of the advantages of the compound bows mentioned heretofore and many novel features that result in a new compound bow with facilitated draw which is not anticipated, rendered obvious, suggested, or even implied by any of the prior art compound bows, either alone or in any combination thereof.

To attain this, the present invention generally comprises a compound bow with an intermediate handle portion having a pair of ends each with a threaded post coupled thereto and extending forwardly therefrom. As shown in FIGS. 1 & 2, the compound bow further includes a pair of resilient limbs each having an inboard end with a bore formed therein for slidably receiving the threaded post. A pair of pulleys are mounted on a side edge of the handle portion and vertically spaced from a center thereof. As best shown in FIG. 2, a portion of each limb adjacent to the inboard end thereof pivots about the associated end of the handle portion of the compound bow. FIG. 4 depicts a set member coupled to a center of the handle portion of the bow and extending rearwardly therefrom. For reasons that will soon become apparent, the set member is equipped with a pin extending laterally therefrom. Also included is a pair of tension assemblies. As best shown in FIG. 2, each tension assembly has a first arm having an inboard end coupled to one of the ends of the intermediate handle portion of the bow. The first arm extends through an elongated slot formed in one of the limbs. An outboard end of the first arm is coupled to an outboard end of one of the threaded posts of the bow. Each tension assembly further includes a second arm having an outboard end hingably coupled to the outboard end of the first arm and the outboard end of one of the threaded posts of the bow. A first pulley is rotatably coupled to a post extending laterally from the outboard end of one of the threaded posts of the bow, as shown in FIG. 2. A roller is rotatably mounted to an inboard end of the second arm in rolling abutment with a front surface of one of the limbs of the bow. The tension assemblies each further include a pair of threaded rods each having a first end hingably mounted to an end of the roller. The threaded rods extend in parallel relationship with one of the limbs of the bow. Further, second ends of the threaded rods are connected via a post which extends laterally from bow with a second pulley thereon. Note FIG. 3. Further provided is a first spring assembly including a coil spring situated about one of the threaded posts between an adjustment nut and one of the limbs of the bow. The first spring assembly serves for urging the inboard end of one of the limbs toward the handle portion thereof. Associated therewith is a second spring assembly including a pair of coil springs each situated about one of the threaded rods between an adjustment nut and a stopper mounted on one of the limbs of the bow. In operation, the second spring assembly is adapted for urging the roller to move upwardly along one of the limbs of the bow. A cable is wrapped about the pulleys of each of the tension assemblies and further positioned between the pulleys of the bow. In operation, the cable may be drawn between the pulleys of the bow and positioned about the pin of the set member for allowing the bow to be more easily drawn. Once the bow is drawn, the cable may be released, thereby reapplying the pressure applied to the limbs by the tension assemblies. This in turn allows the bow to be released at full strength.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new compound bow with facilitated draw apparatus and method which has many of the advantages of the compound bows mentioned heretofore and many novel features that result in a new compound bow with facilitated draw which is not anticipated, rendered obvious, suggested, or even implied by any of the prior art compound bows, either alone or in any combination thereof.

It is another object of the present invention to provide a new compound bow with facilitated draw which may be easily and efficiently manufactured and marketed.

It is a further object of the present invention to provide a new compound bow with facilitated draw which is of a durable and reliable construction.

An even further object of the present invention is to provide a new compound bow with facilitated draw which is susceptible of a low cost of manufacture with regard to both materials and labor, and which accordingly is then susceptible of low prices of sale to the consuming public, thereby making such compound bow with facilitated draw economically available to the buying public.

Still yet another object of the present invention is to provide a new compound bow with facilitated draw which provides in the apparatuses and methods of the prior art some of the advantages thereof, while simultaneously overcoming some of the disadvantages normally associated therewith.

Still another object of the present invention is to provide a new compound bow with facilitated draw for allowing a bow string to be more easily drawn after which a strength of the bow may be restored prior to release.

Even still another object of the present invention is to provide a new draw facilitating bow assembly for use with a compound bow including a set member coupled to a handle portion of the bow and extending rearwardly therefrom. Also included is a pair of tension assemblies mounted on ends of the bow. Next provided is a cable wrapped about the tension assemblies for being removably positioned on the set member for allowing the bow to be more easily drawn.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
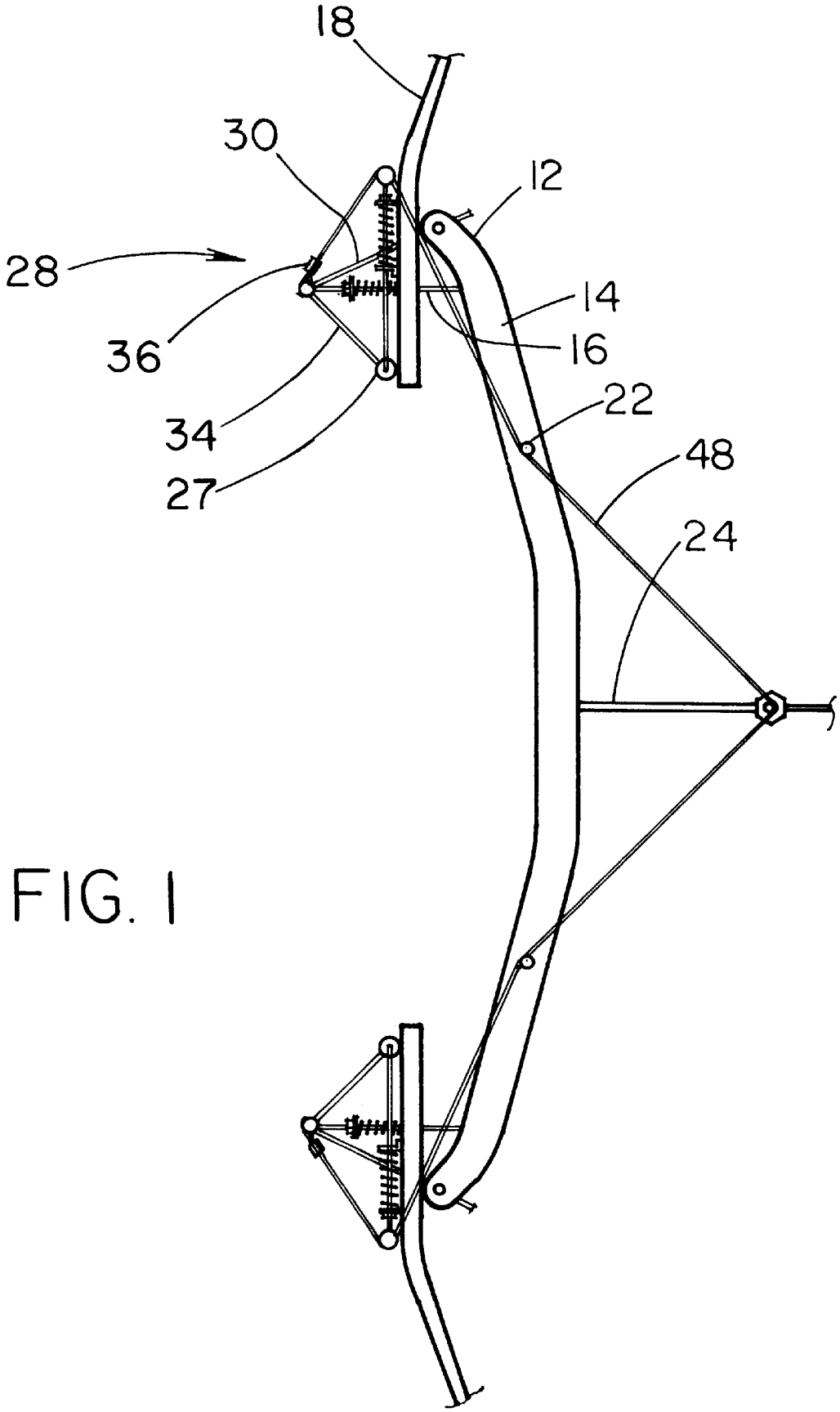
FIG. 1 is a side view of a new compound bow with facilitated draw according to the present invention.

With reference now to the drawings, and in particular to FIGS. 1 through 9 thereof, a new compound bow with facilitated draw em bodying the principles and concepts of the present invention and generally designated by the reference numeral 10 will be described.

Figure 2:
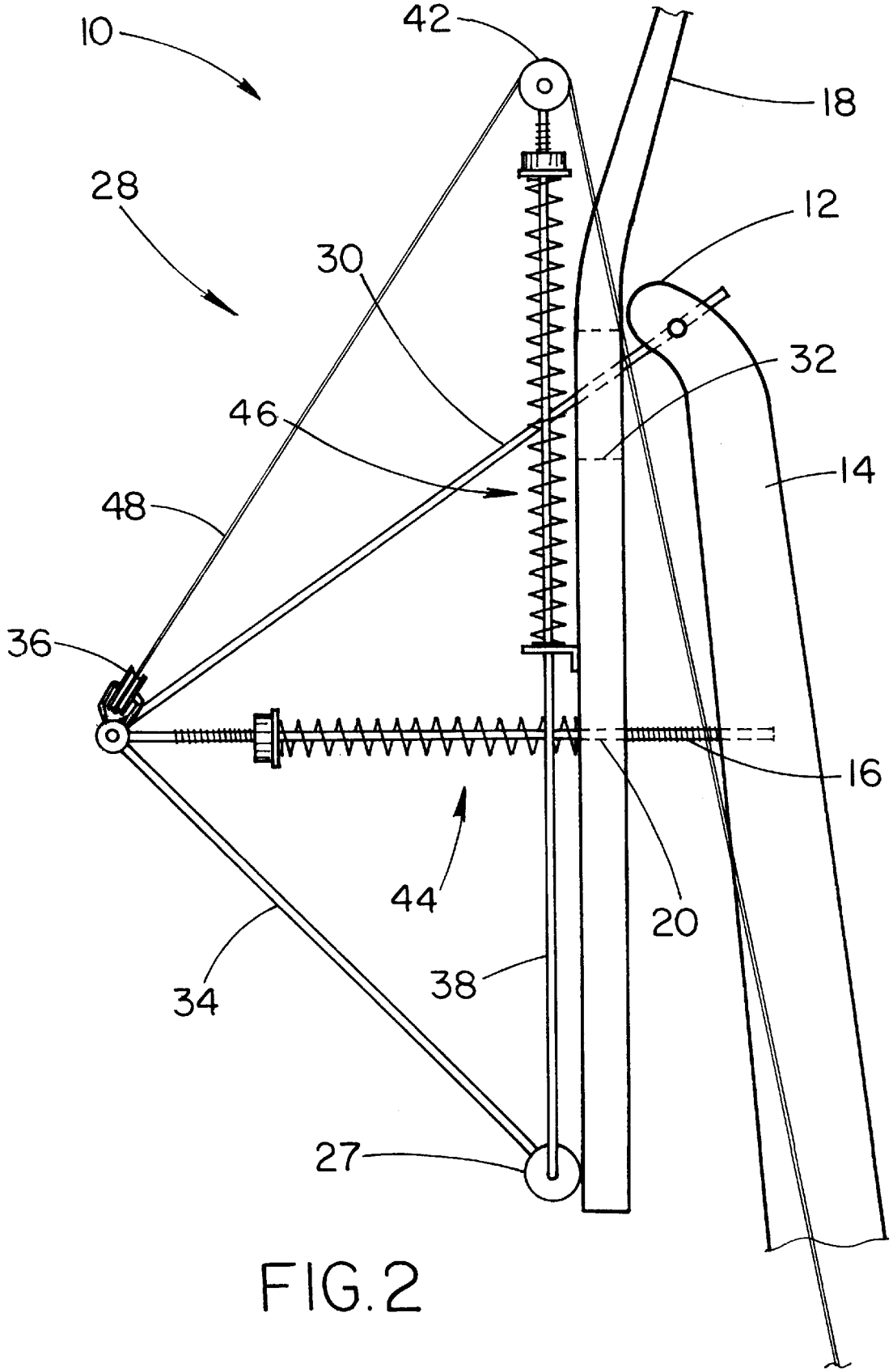
FIG. 2 is a detailed side view of one of the tension assemblies of the present invention.
Figure 3:
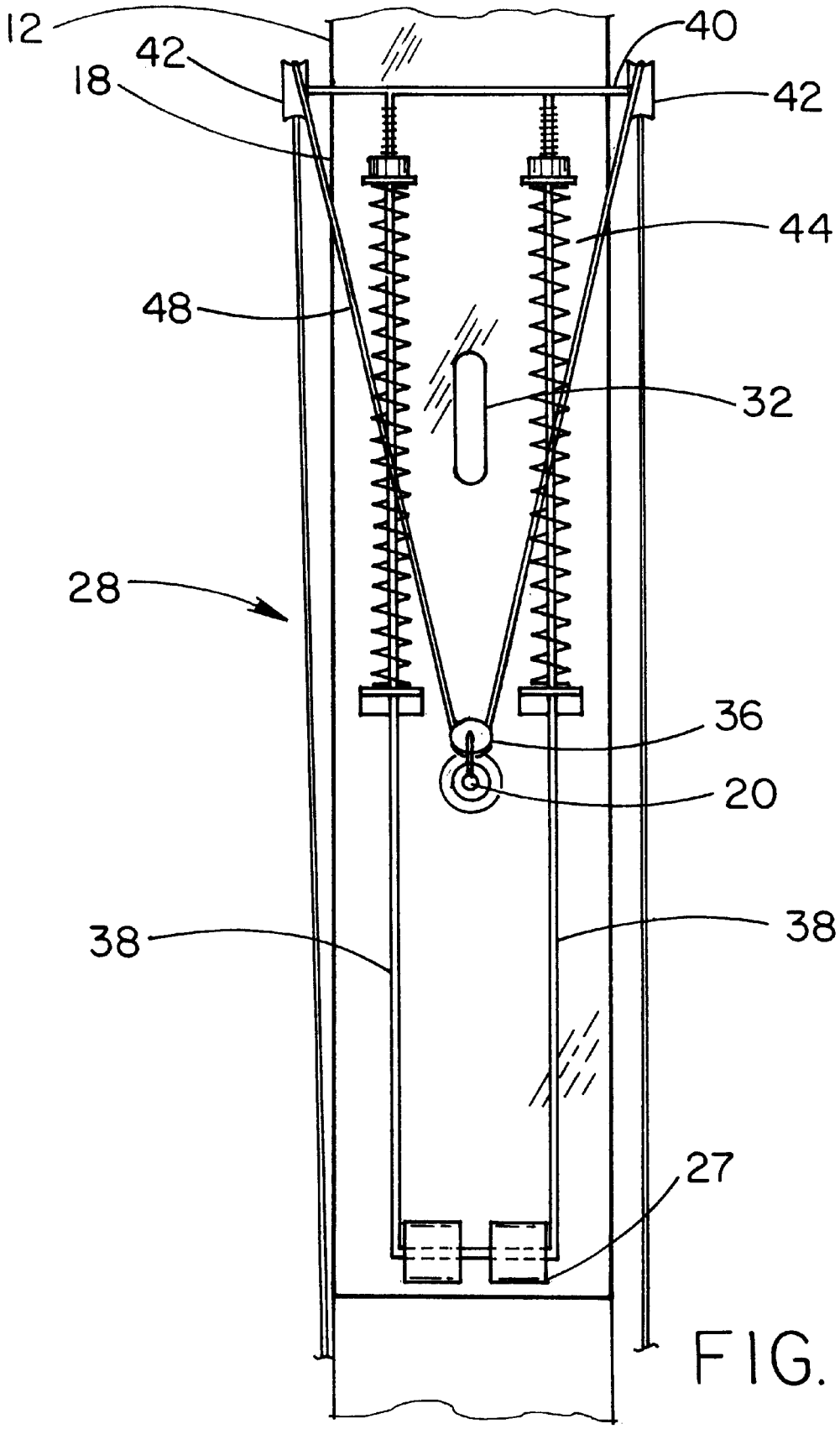
FIG. 3 is a front view of a portion of one of the tension assemblies of the pre sent invention.

The present invention, designated as numeral 10, includes a compound bow 12 with an intermediate handle portion 14 having a pair of ends each with a threaded post 16 coupled thereto and extending forwardly therefrom. As shown in FIGS. 1 & 2, the compound bow further includes a pair of resilient limbs 18 each having a n inboard end with a bore 20 formed therein which is dimensioned for slidably receiving the threaded post. Each distal end of the main limb is coupled to a main string pulley 54 and a main string 52 is threaded through the main string pulleys 54. A pair of pulleys 22 are mounted on a side edge of the handle portion and vertically spaced from a center thereof for reasons that will soon become apparent. As best shown in FIG. 2, a portion of each limb adjacent to the inboard end thereof pivots about the associated end of the handle portion of the compound bow.

Figure 4:
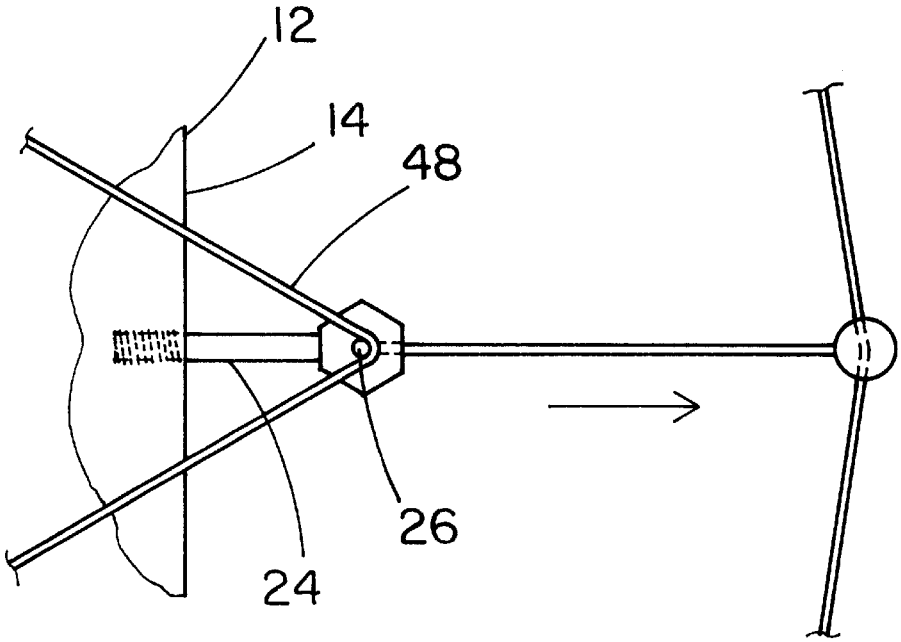
FIG. 4 is a side view of the set member and pin of the present invention.

FIG. 4 depicts a set member 24 coupled to a center of the handle portion of the bow and extending rearwardly therefrom. For reasons that will soon become apparent, the set member is equipped with a pin 26 extending laterally therefrom.

Also included is a pair of tension assemblies 28. As best shown in FIG. 2, each tension assembly has a first arm 30 having an inboard end coupled to the associated end of the intermediate handle portion of the bow. Ideally, such coupling is afforded by a slot formed in the first arm that slidably receives a set screw or the like for allowing adjustment of the length of the first arm. The first arm extends through an elongated slot 32 formed in the associated limb. An outboard end of the first arm is coupled to an outboard end of the associated threaded post of the bow. Each tension assembly further includes a second arm 34 having an outboard end hingably coupled to the outboard end of the first arm and the outboard end of the associated threaded posts of the bow. It should be well understood that the foregoing hinged coupling may be afforded by way of any desired mechanism such as a sleeve rotatably received on a lateral tab on the threaded post or first arm.

A first pulley 36 is rotatably coupled to a post extending laterally from the outboard end of the associated threaded post of the bow, as shown in FIG. 2. A roller 27 is rotatably mounted to an inboard end of the second arm in rolling abutment with a front surface of the associated limb of the bow. Similar to the outboard end of the second arm, the inboard end may be equipped with a sleeve which may be rotatably received by an intermediate portion of the roller having a reduced diameter. In the alternative, any other type of mechanism may be employed.

The tension assemblies each further include a pair of threaded rods 38 each having a first end hingably mounted to an end of the roller in manner similar to the second arm or the like. The threaded rods extend in parallel relationship with the associated limb of the bow. Further, second ends of the threaded rods are connected via a post 40 which extends laterally from bow with a second pulley 42 thereon. Note FIG. 3.

Further provided is a first spring assembly 44 including a coil springs situated about the associated threaded post and between an adjustment nut and the associated limb of the bow. Note FIG. 2. The first spring assembly serves for urging the inboard end of the associated limb toward the handle portion of the bow. Associated therewith is a second spring assembly 46 including a pair of coil springs each situated about one of the threaded rods of the associated tension assembly and between an adjustment nut and a stopper mounted on the limb of the bow. Ideally, such stopper includes a pair of stops each having an aperture or slot for passing the threaded rods 38. In operation, the second spring assembly is adapted for urging the roller to move upwardly along the associated limb of the bow. Similar to the first assembly, this urges the inboard end of the associated limb toward the handle portion of the bow. The adjustment nuts of both spring assemblies may be used to increase the force with which the spring assemblies carry out their intended function.

A cable 48 is wrapped about the pulleys of each of the tension assemblies and further positioned between the pulleys of the bow. In operation, the cable may be drawn between the pulleys of the bow and positioned about the pin of the set member for allowing the bow to be more easily drawn. This is accomplished by pivoting the inboard ends of the limbs outwardly against the force of the springs. This in turn allows the outboard ends of the limbs to be pivoted rearwardly more easily as the bow is drawn. Once the bow is drawn, the cable may be released, thereby allowing the tension assemblies to again apply pressure to the limbs. This in turn allows the bow to be released at full strength. It should be noted that the cable may be released when the bow is drawn by any desired release mechanism. For example, a sleeved cable or the like may be connected between the pin and the bow string of the bow. When the bow string is drawn, a button or lever may be depressed to effect the release of the cable by the pin. In an alternate embodiment, the set member may be biased with a hand of the user that is being used to hold the handle portion of the bow.

Figure 5:
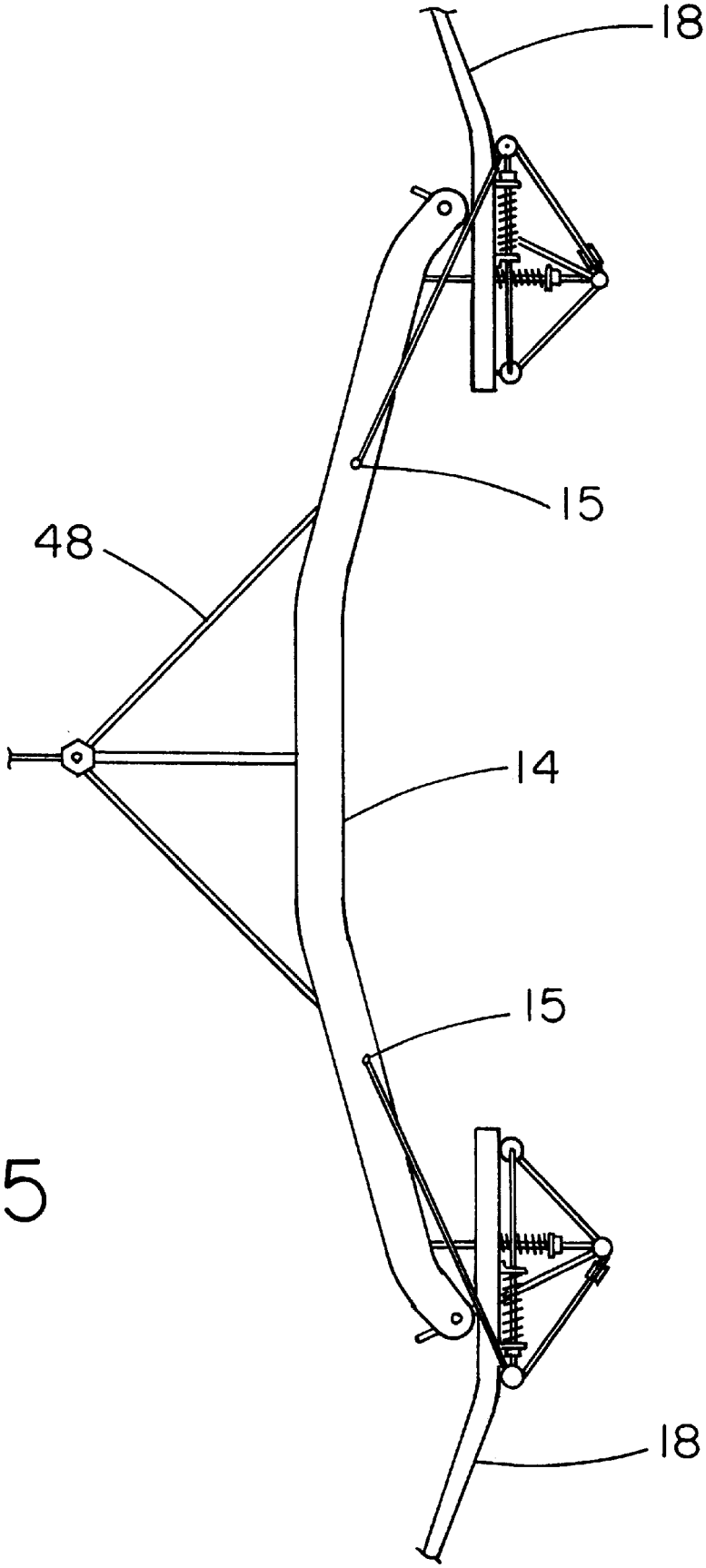
FIG. 5 is side view of the present invention.

As shown in FIG. 5, the cable 48 has ends attached to the handle portion at points 15.

Figure 7:
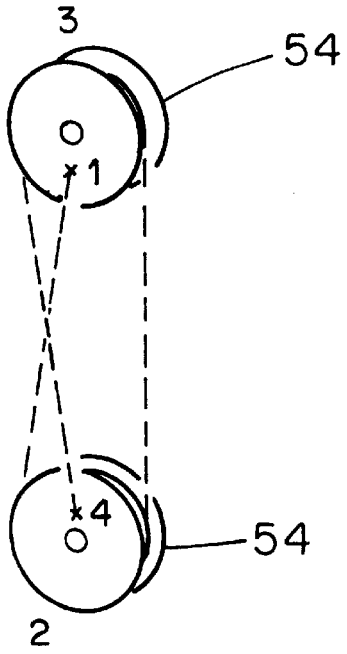
FIG. 7 is an exploded view of the threading of the main string.
Figure 6:
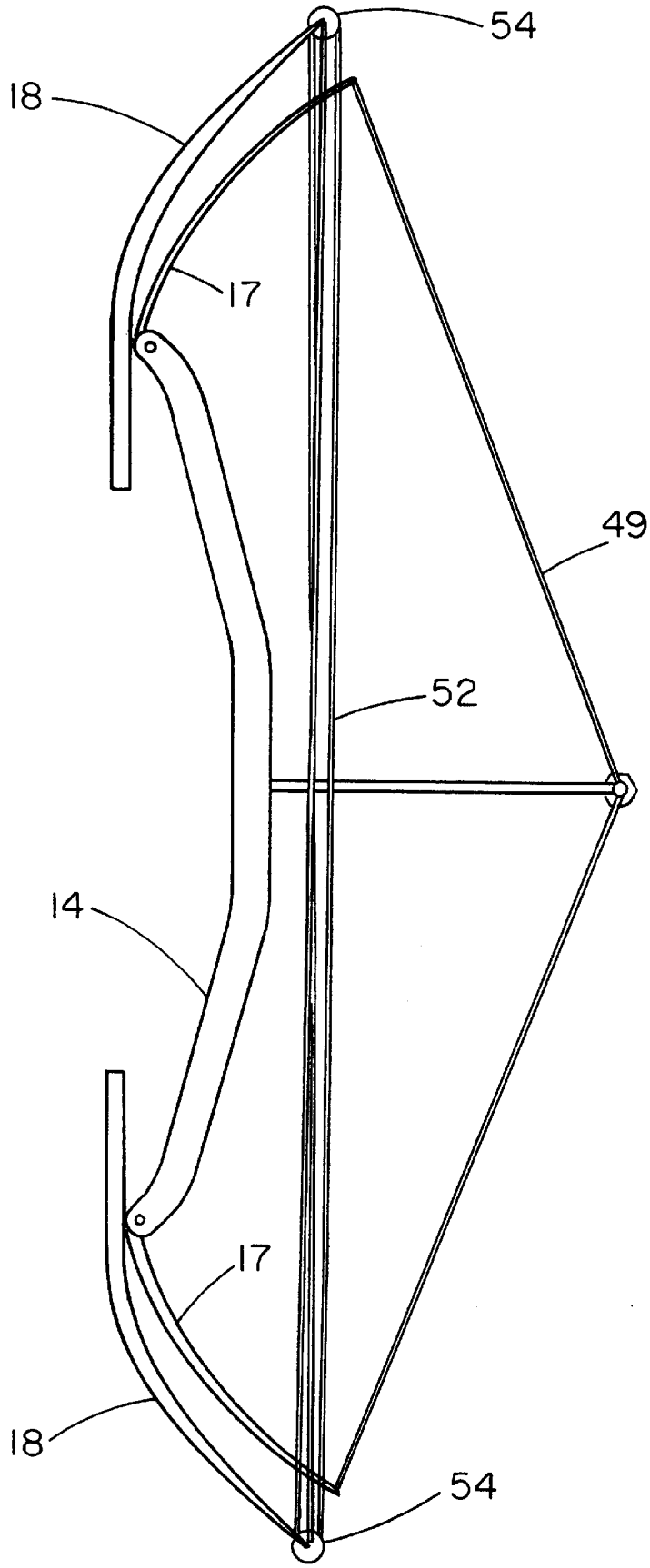
FIG. 6 is a side view of an embodiment of the invention.

With regard to FIG. 6, a second limb 17 is coupled to the handle portion and positioned proximate each main limb. The second limbs are pulled to full draw by drawing on the cable 49, then the main string 52 is pulled and set. After the main string is set, the cable 49 is released to permit full tension on the drawn main string for propelling an arrow. FIG. 7 demonstrates a possible configuration for the threading of main string 52 between pulleys 54 coupled to distal ends of the main limbs.

Figure 8:
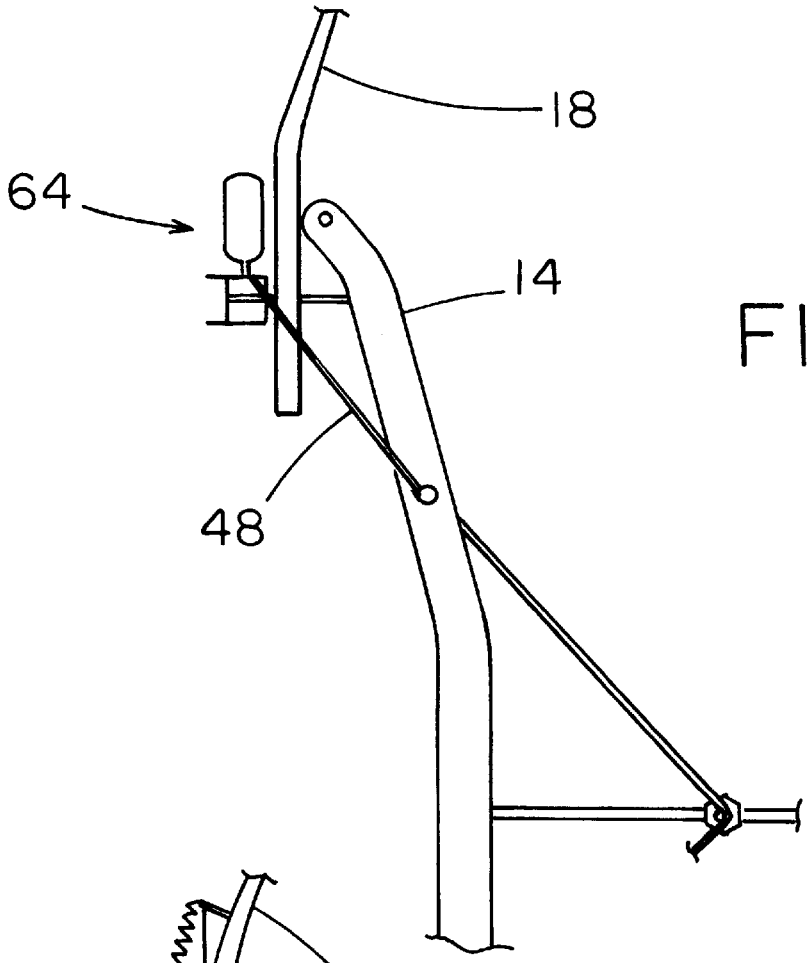
FIG. 8 is side view of an embodiment of the invention.
Figure 9:
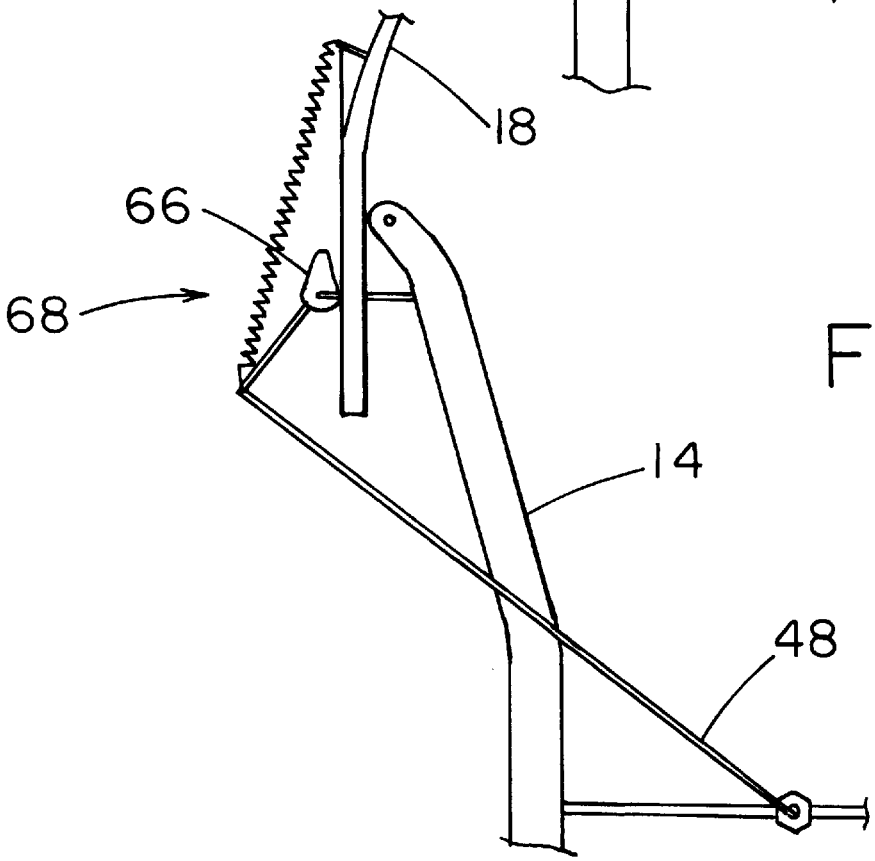
FIG. 9 is side view of an embodiment of the invention.

As shown in FIGS. 8 and 9, tension may be created in the main limbs using a gas cartridge assembly 64 or a cam 66 and spring assembly 68 in place of each tension assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A draw facilitating bow system comprising, in combination:

a compound bow with an intermediate handle portion with a pair of ends each having a threaded post coupled thereto and extending forwardly therefrom, the compound bow further including a pair of resilient limbs each having an inboard end with a bore formed therein for slidably receiving the threaded post and a pair Of pulleys mounted on a side edge of the handle portion and vertically spaced from a center thereof, wherein a portion of each limb adjacent to the inboard end thereof pivots about the associated end of the handle portion of the compound bow;

a set member coupled to a center of the handle portion of the bow and extending rearwardly therefrom with a pin extending laterally therefrom;

a pair of tension assemblies each including:

a first arm having an inboard end coupled to one of the ends of the intermediate handle portion of the bow and extending through an elongated slot formed in one of the limbs and an outboard end coupled to an outboard end of one of the threaded posts of the bow, a second arm having an outboard end hingably coupled to the outboard end of the first arm and the outboard end of one of the threaded posts of the bow, a first pulley rotatably coupled to a post extending laterally from the outboard end of one of the threaded posts of the bow, a roller rotatably mounted to an inboard end of the second arm in rolling abutment with a front surface of one of the limbs of the bow, a pair of threaded rods each having a first end hingably mounted to an end of the roller and extending in parallel relationship with one of the limbs of the bow, wherein second ends of the threaded rods are connected via a post which extends laterally from the bow with a second pulley thereon, a first spring assembly including a coil spring situated about one of the threaded posts between an adjustment nut and one of the limbs of the bow for urging the inboard end of one of the limbs toward the handle portion thereof, and a second spring assembly including a pair of coil springs each situated about one of the threaded rods between an adjustment nut and a stopper mounted on one of the limbs of the bow for urging the roller to move upwardly along one of the limbs of the bow; and a cable wrapped about the pulleys of each of the tension assemblies and further positioned between the pulleys of the bow for being positioned about the pin of the set member for allowing the bow to be more easily drawn.

2. A draw facilitating bow system comprising, in combination:

a compound bow having a handle portion, said handle portion having a pair of ends, each end having a threaded post coupled thereto and extending forwardly therefrom;

the compound bow further including a pair of resilient limbs, each limb having a bore formed therein for receiving the threaded post;

the compound bow further including a pair of pulleys mounted on the handle portion, wherein a portion of each limb adjacent to the inboard end thereof pivots about the associated end of the handle portion of the compound bow;

a set member coupled to the handle portion of the bow and extending rearwardly therefrom, the set member having a pin extending laterally therefrom;

a pair of tension assemblies each including:

a first arm having an inboard end coupled to one of the ends of the handle portion of the bow and extending through a slot formed in one of the limbs and an outboard end coupled to an outboard end of one of the threaded posts of the bow, a second arm having an outboard end coup led to the outboard end of the first arm and the outboard end of one of the threaded posts of the bow, a first pulley coupled to a post extending from the outboard end of one of the threaded posts of the bow, a roller mounted to an inboard end of the second arm in abutment with a front surface of one of the limbs of the bow, a pair of threaded rod s each having a first end mounted to an end of the roller and extending in parallel relationship with one of the limbs of the bow, wherein second ends of the threaded rods are connected via a post which extends laterally from the bow with a second pulley thereon, a first spring assembly for urging the inboard end of one of the limbs toward the handle portion thereof, and a second spring assembly for urging the roller to move upwardly along one of the limbs of the bow; and a cable wrapped about the pulleys of each of the tension assemblies and further positioned between the pulleys of the bow for being positioned about the pin of the set member for allowing the bow to be more easily drawn.

3. The draw facilitating bow assembly of claim 2 further comprising:

said first spring assembly including a coil spring situated about one of the threaded posts between an adjustment nut and one of the limbs of the bow.

4. The draw facilitating bow assembly of claim 2, further comprising:

said second spring assembly including a pair of coil springs each situated about one of the threaded rods between an adjustment nut and a stopper mounted on one of the limbs of the bow.

* * * * *